US007237673B2

(12) United States Patent
Wikle et al.

(10) Patent No.: US 7,237,673 B2
(45) Date of Patent: Jul. 3, 2007

(54) CONTAINER FOR TOOL BITS

(75) Inventors: David Wikle, York, PA (US); Mark E Brunson, Bel Air, MD (US); Jennifer Ervin, Annapolis, MD (US)

(73) Assignee: Black & Decker Inc., Newark, DE (US)

( * ) Notice: Subject to any disclaimer, the term of this patent is extended or adjusted under 35 U.S.C. 154(b) by 187 days.

(21) Appl. No.: 10/990,305

(22) Filed: Nov. 16, 2004

(65) Prior Publication Data

US 2005/0077198 A1 Apr. 14, 2005

Related U.S. Application Data

(63) Continuation-in-part of application No. 10/781,052, filed on Feb. 18, 2004, now Pat. No. 7,165,674, and a continuation-in-part of application No. 10/694,472, filed on Oct. 27, 2003, which is a continuation of application No. 10/126,500, filed on Apr. 19, 2002, now Pat. No. 6,698,609, which is a continuation-in-part of application No. 09/840,278, filed on Apr. 23, 2001, now Pat. No. 7,048,133.

(51) Int. Cl.
*B65D 85/20* (2006.01)

(52) U.S. Cl. ..... 206/379; 206/443; 206/776; 206/338

(58) Field of Classification Search ..... 206/214, 206/261, 368, 369, 372–379, 443, 459.5, 206/472–475, 523, 526, 527, 216, 338; 220/523, 220/526, 527

See application file for complete search history.

(56) References Cited

U.S. PATENT DOCUMENTS

| | | | | |
|---|---|---|---|---|
| 416,425 | A | 12/1889 | Schmitt | |
| RE13,408 | E * | 4/1912 | Sine | 211/69 |
| 1,849,565 | A | 3/1932 | Brady | |
| 2,012,800 | A | 8/1935 | Allen | |
| 2,305,021 | A * | 12/1942 | Meier | 206/379 |
| 2,408,227 | A * | 9/1946 | Ramsey | 206/379 |
| 2,564,601 | A * | 8/1951 | Huot | 206/379 |
| 2,589,234 | A * | 3/1952 | Drohman | 206/379 |
| 3,459,327 | A | 8/1969 | Harris | |

(Continued)

FOREIGN PATENT DOCUMENTS

| | | |
|---|---|---|
| DE | 1814157 | 12/1968 |

(Continued)

*Primary Examiner*—Mickey Yu
*Assistant Examiner*—Jerrold Johnson
(74) *Attorney, Agent, or Firm*—Harness, Dickey & Pierce, P.L.C.

(57) ABSTRACT

A storage container for housing bits includes a first housing portion and a second housing portion pivotally connected through a hinge for moving between open and closed positions. The first housing portion defines a first body cavity and the second housing portion defines a second body cavity in the closed position. At least one bit holder is pivotally connected to the hinge and arranged to fit within the first body cavity in the closed position. The bit holder includes a plurality of bit receiving portions formed thereon for accepting the bits. The bit receiving portions are generally parallel to the hinge. A cover is pivotally connected to the second housing portion and moveable between open and closed positions for accessing the second body cavity.

18 Claims, 2 Drawing Sheets

U.S. PATENT DOCUMENTS

| | | | | |
|---|---|---|---|---|
| 3,698,404 | A | 10/1972 | Greco | |
| D229,366 | S | 11/1973 | Yonce | |
| 3,836,043 | A | 9/1974 | Levin | |
| 4,151,912 | A * | 5/1979 | Harrold | 206/338 |
| 4,210,252 | A | 7/1980 | Cooke et al. | |
| 4,213,532 | A | 7/1980 | Eggert et al. | |
| D264,396 | S | 5/1982 | Harvey et al. | |
| 4,615,464 | A | 10/1986 | Byrns | |
| 4,884,689 | A | 12/1989 | Su-Chin | |
| 4,930,753 | A | 6/1990 | Alvyn | |
| 4,934,549 | A | 6/1990 | Allen | |
| 5,050,733 | A | 9/1991 | Brennan | |
| D333,727 | S | 3/1993 | Schurman | |
| D345,650 | S | 4/1994 | Boyd | |
| D347,114 | S | 5/1994 | Tengvall | |
| 5,553,710 | A | 9/1996 | Takama | |
| D390,358 | S | 2/1998 | Calmeise | |
| D400,011 | S | 10/1998 | Palmer et al. | |
| 5,915,553 | A | 6/1999 | Brown et al. | |
| D417,077 | S | 11/1999 | Sheu | |
| D418,977 | S | 1/2000 | Streich | |
| 6,698,609 | B2 * | 3/2004 | Pangerc et al. | 220/23.87 |
| 2003/0085141 | A1 * | 5/2003 | Huang | 206/372 |

FOREIGN PATENT DOCUMENTS

| | | | |
|---|---|---|---|
| DE | 2149305 | | 10/1971 |
| DE | 3150873 | A1 | 12/1981 |
| DE | 85006459 | | 1/1985 |
| DE | G8515834.8 | | 5/1985 |
| DE | G8602551.1 | | 1/1986 |
| DE | 3714789 | C2 | 5/1987 |
| DE | G8814319.8 | | 11/1988 |
| DE | G8906411.9 | | 5/1989 |
| DE | G8907073.9 | | 6/1989 |
| DE | G9312160.1 | | 8/1993 |
| DE | 29517259 | U1 | 10/1995 |
| DE | 29702619 | U1 | 2/1997 |
| EP | 0620159 | B1 | 3/1997 |
| WO | WO90/08631 | | 8/1990 |
| WO | WO94/11258 | | 5/1994 |

* cited by examiner

CONTAINER FOR TOOL BITS

CROSS-REFERENCE TO RELATED APPLICATIONS

This application is a continuation-in-part of U.S. patent application Ser. No. 10/781,052 filed on Feb. 18, 2004 and application Ser. No. 10/694,472 filed on Oct. 27, 2003, now U.S. Pat. No. 7,165,674, which is a continuation-in-part of Ser. No. 10/126,500 filed on Apr. 19, 2002, now U.S. Pat. No. 6,698,609, which is a continuation-in-part of Ser. No. 09/840,278 filed on Apr. 23, 2001 now U.S. Pat. No. 7,048,133, The disclosures of the above applications are incorporated herein by reference.

FIELD OF THE INVENTION

The present invention relates generally to storage containers, and more particularly to a storage container having a unique divider system and independently hinged sleeves for retaining drill bits.

BACKGROUND

Storage containers exist in many varieties and may be used to store, organize and transport various items such as fasteners, tool bits and other accessories. Plastic storage containers can be typically manufactured fairly inexpensively, but often at the expense of being less rigid and providing less flexibility in adapting the storage container to store items of various sizes. When a storage container is used to store tool accessories such as drill bits on a job site, it is desirable for the user to be able to quickly identify and access the drill bit of interest. Sometimes however, a large collection of drill bits of random size are staggered within a storage container such that identification and access is cumbersome.

Furthermore, storage containers that incorporate organizational schemes often present the drill bits in a structured pattern such that the user may easily identify the drill bit of interest but do not allow the user convenient access to remove or replace the drill bit from its holding arrangement. In addition, a storage case must be built to be strong and durable so that if it is moved quickly or dropped, it will not allow smaller drill bits to slide out of their respective holding arrangements.

SUMMARY OF THE INVENTION

A storage container for housing bits includes a first housing portion and a second housing portion pivotally connected through a hinge for moving between open and closed positions. The first housing portion defines a first body cavity and the second housing portion defines a second body cavity in the closed position. At least one bit holder is pivotally connected to the hinge and arranged to fit within the first body cavity in the closed position. The bit holder includes a plurality of bit receiving portions formed thereon for accepting the bits. The bit receiving portions are generally parallel to the hinge. A cover is pivotally connected to the second housing portion and moveable between open and closed positions for accessing the second body cavity.

According to other features, the second housing portion includes at least one internal lateral divider wall having a series of locating tabs extending therefrom. At least one adjustable spacer is provided for selectively positioning between the locating tabs. The adjustable spacer includes a first and second side having a first and second end. The first and second sides are flared outwardly at the first and second ends. A retaining member extends from the first housing portion into the first body cavity and is adapted to extend adjacent to predetermined bits of the bit holder to preclude movement of the drill bits out of the bit receiving portions while the first housing portion is in the closed position.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
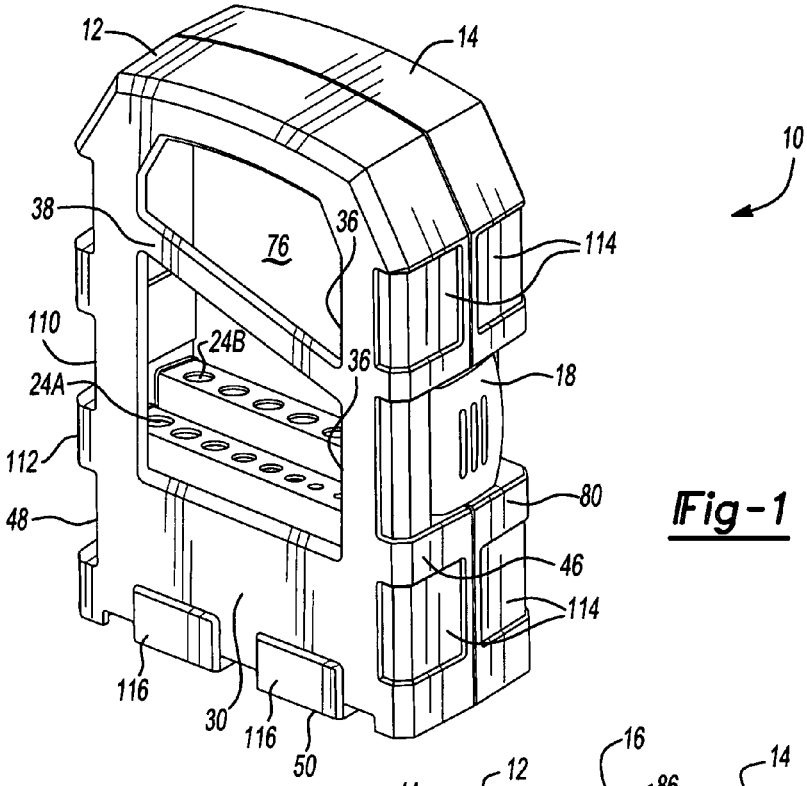
FIG. 1 is a front perspective view of a storage container constructed in accordance to the teachings of the present invention and shown in a closed position.

The following description of the preferred embodiment(s) is merely exemplary in nature and is in no way intended to limit the invention, its application, or uses.

With reference to the FIGS., a bit container according to the present invention is illustrated and generally identified at reference 10. The container 10 includes a front shell housing portion 12 and a rear shell housing portion 14. The front shell housing portion 12 is connected to the rear shell housing portion 14 through a hinge 16. A latch 18 is connected to the front housing 12 and pivots to an engaged position to engage the rear housing portion 14.

Figure 2:
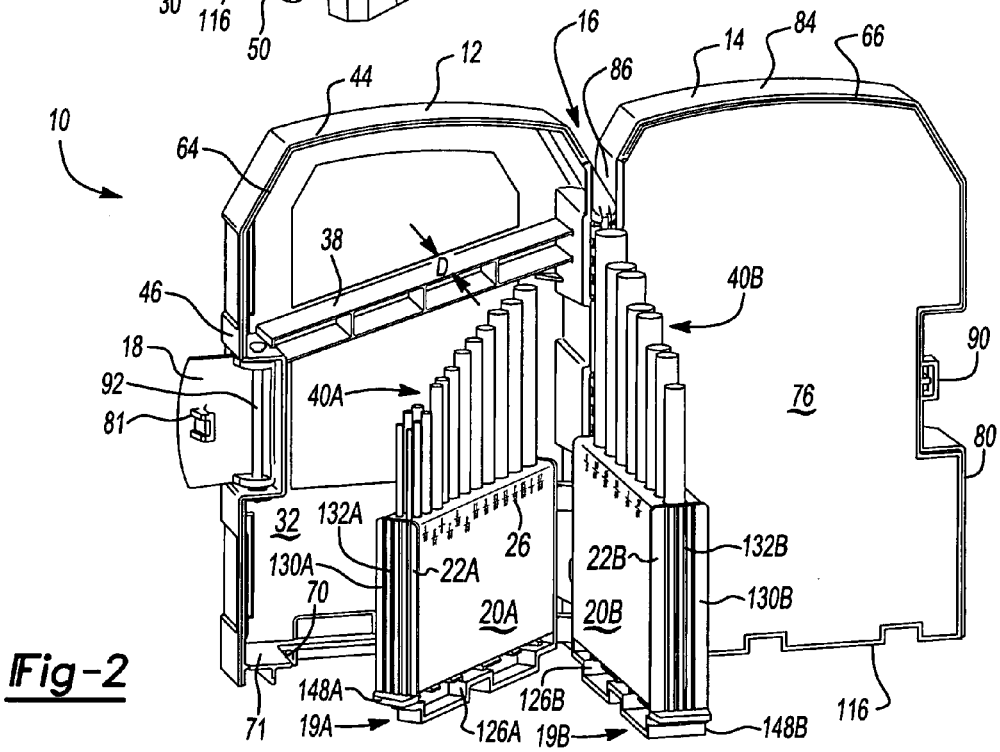
FIG. 2 is a front perspective view of the storage container of FIG. 1 shown in an open position.

With specific reference to FIGS. 1 and 2, two page-like bit holders 19A and 19B are pivotally disposed within the front shell housing position 12 of the container 10. The page-like bit holders 19A and 19B generally include metal sleeves 20A and 20B which are each received within corresponding frame body portions 22A and 22B. The frame body portions 22A and 22B are formed as part of the hinge 16. Each of the metal sleeves 20A and 20B include apertures 24A and 24B (FIG. 1) incorporated in the respective metal sleeves 20A and 20B for receiving various sized drill bits. The apertures 24A and 24B may be configured to accept metric or English unit drill bits, or both. Preferably, the apertures 24A and 24B are arranged with increased diameter across each of the metal sleeves 20A and 20B for convenience and ease of identification. In addition, drill bit size indicators 26 are etched on both sides of the metal sleeves 20A and 20B (most clearly shown on FIG. 2). The frame body portions 22A and 22B are pivotal relative to the front and rear shell housing portions 12, 14 to allow the page-like bit holders 19A and 19B to be flipped like pages relative to the housing portions 12, 14.

With continued reference to FIGS. 1 and 2, the front housing portion 12 will be described in greater detail. The front housing portion 12 generally includes a front outer face 30 and a front inner face 32 having an optional viewing passage 36 incorporated therethrough. A diagonal strip 38 is disposed across the viewing passage 36 and incorporates a depth D (most clearly shown in FIG. 2) into an inner cavity of the front housing portion 12 of the container 10. The diagonal strip 38 is arranged to align with the tips of a series of drill bits 40A disposed in the sleeve 20A. In this way, the diagonal strip 38 precludes axial movement of the drill bits 40A in the sleeve 20A from sliding toward a top surface 44 of the front housing portion 12 while the container is in a closed position or while in an open position with the sleeve 20A positioned against the front housing portion 12. The viewing passage 36 may comprise an aperture, an aperture having a transparent panel fitted thereon or, alternately, the front outer face 30 of the front housing portion 12 may be solid to prevent viewing or otherwise access therethrough.

The front housing portion 12 is further defined by a peripheral side wall including a side latch face 46, a side hinge face 48, a bottom face 50 (FIG. 1) and the top surface 44 (FIG. 2). A groove 64 (best shown in FIG. 2) extends around an inner edge of the top surface 44 and the side latch face 46 of the front housing portion 12 to cooperate with a complimentary lip 66 on the rear housing portion 14 in a closed position. The bottom face 50 of the front shell housing portion 12 incorporates an inset portion 70, as illustrated in FIG. 2, for accommodating the frame body portions 22A and 22B while in a closed position. A ledge 71 provides vertical support for the page-like bit holders 19A and 19B when the container 10 is in a closed position.

Figure 3:
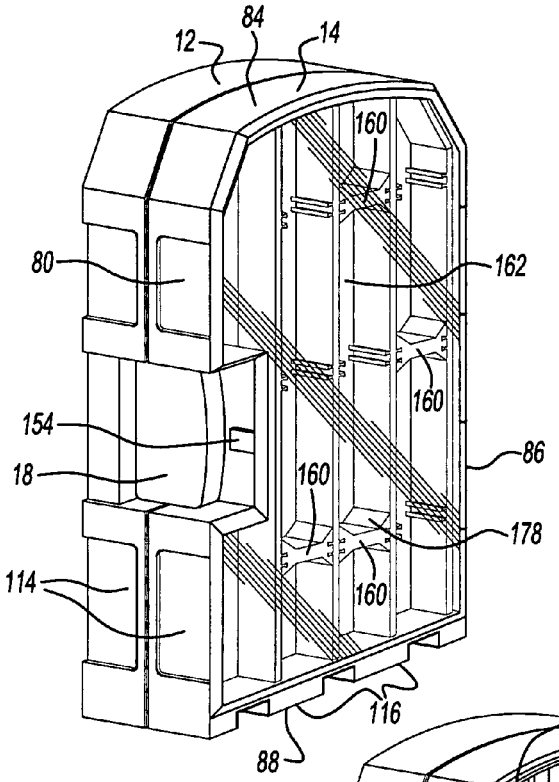
FIG. 3 is a rear perspective view of the storage container of FIG. 1 shown in a closed position.
Figure 4:
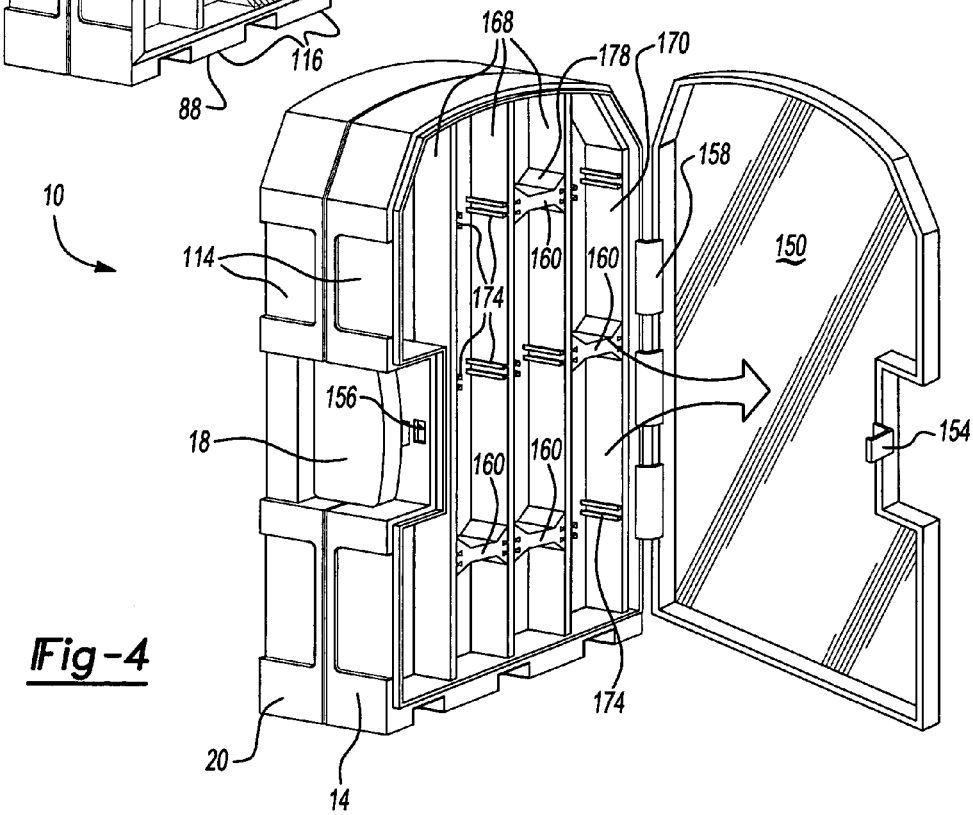
FIG. 4 is a rear perspective view of the storage container of FIG. 3 shown in an open position.

With continued reference to FIG. 2 and further reference to FIGS. 3 and 4, the outer structure of the rear housing 14 will be further described. The rear shell housing portion 14 is defined by a peripheral side wall extending from an intermediate face 76 (FIG. 2). The peripheral side wall of the rear housing portion 14 includes a side latch face 80, a top wall 84, a side hinge wall 86 and a bottom wall 88 (FIG. 3). The groove 66 (FIG. 2) is formed on an inner edge of the top wall 84 and the side latch face 80 of the rear housing portion 14.

With particular reference to FIG. 2, the latch 18 will be described in greater detail. A catch 90 extends from the side latch face 80 of the rear housing portion 14 for catching a tooth 81 incorporated on an underside of the latch 18 in an engaged position. The latch 18 is pivotally rotatable about a pivot post 92 connected to the front housing portion 12.

The front and rear housing portions 12, 14 are preferably comprised of hard plastic such as high impact ABS. As shown in FIG. 1, various inset and outset portions 110, 112 are incorporated on the side hinge face 48 of the front housing portion 12 for structural integrity. While not specifically shown, the rear housing portion 14 includes similar inset and outset portions formed on the side hinge face 96. The side latch faces 46, 80 of the front and rear housing portions 12, 14 incorporate indentations 114 thereon, to improve structural integrity and robustness.

Referring now to FIG. 2, the metal sleeves 20A and 20*b* will be described in greater detail. The metal sleeves 20A and 20B are preferably arranged in increasing height from front to rear of the front housing portion 12 of the storage container 10. Likewise, a series of smaller drill bits 40A are received within the shorter front sleeve 20A while a series of larger drill bits 40B are received within the taller rear sleeve 20B. This arrangement allows convenient viewing of the drill bits to properly identify the drill bit of interest. In addition, the hinged configuration of the metal sleeves 20A and 20B allows a user to index freely through the page-like bit holders 19A and 19B to gain adequate access to remove or insert a particular drill bit.

Both frame body portion 22A and 22B incorporates a stepped surface 126A and 126B thereon. The stepped arrangement provides increased structural integrity consistent with the aforementioned inset and outset portions 110 and 112 of the front and rear housing portion 10, 12. Side surfaces 130A and 130B of each of the frame body portions 22A and 22B include ridges 132A and 132B formed therealong. The ridges 132A and 132B provide an improved gripping surface to facilitate indexing through the page-like bit holders 19A and 19B.

The storage container 10 incorporates a variety of surfaces that allow the storage container to free-stand thereon. Specifically, the outset portions 112 (see, e.g. FIG. 1) arranged on the hinge faces 48 and 86 present a favorable side plane having a sufficient footprint to rest thereon. Furthermore, protruding sections 116 are formed on the front and rear housing portions 12 and 14 (see e.g. FIGS. 1 and 3) and cooperate with the lower faces of the stepped surfaces 126A and 126B incorporated on the bit holders 19A and 19B to present a common plane of which the storage container may free-stand thereon (see e.g. FIG. 2). In this way, the protruding sections 116 and the lower faces of the stepped surfaces 126A and 126B communicate with the common plane at a fully open position and a fully closed position and throughout all positions between providing a plurality of free standing conditions on the common plane.

Feet 148A and 148B extend from each respective frame body portion 22A and 22B in a lateral direction with respect to the ledge 71 of the front housing portion 12. The foot 148A and a portion of the foot 148B overlap the ledge 71 when the page-like bit holders 19A and 19B are rotated against the front inner face 32 of the front housing portion 12. The ledge 71, aligned beneath the feet 148A and 148B, inhibits downward vertical deflection of the page-like bit holders 19A and 19B thereby enhancing structural robustness and reducing stress on the hinge 16 in the event of dropping or otherwise jolting the container 10. It should be understood that the overlapping feet of the frame body portions of the page-like bit holders do not need to extend laterally from the bit holders, but instead can be formed in any manner to cause a portion of the bit holders to simply overlap the ledge 71.

With reference now to FIGS. 3 and 4 the rear housing portion 14 will be described in greater detail. A transparent cover plate 150 is provided for selectively enclosing the storage cavity defined by the rear housing portion 14. A latch 154 releaseably secures the transparent cover plate 150 to a hook 156 on the rear housing portion 14. A cover hinge 158 allows the transparent cover plate 150 to pivot about the rear housing portion 14. It is appreciated that the latch 154 is merely exemplary and any latch or securing member may similarly be incorporated to secure the transparent cover plate 150 to the rear housing portion 14.

The storage container 10 includes removable spacers 160 that may be selectably positioned within the storage cavity of the rear housing portion 14 to customize the interior space. An inner surface 162 of the rear housing portion 14 includes parallel dividers 168 extending between the top wall 84 and the bottom wall 88. The parallel dividers 168 and an inner side wall 170 include tabs 174 extending therefrom. The tabs 174 are configured to engage fingers 178 of the removable spacers 160 in an installed position. The opposing tabs 174 are laterally offset a predetermined distance such that a readily available piece of material may be substituted for a spacer 160, in the event a spacer is misplaced. The predetermined distance is configured to be a distance common to readily available scrap pieces of material such as, but not limited to, ⅛ inch plywood.

A series of spacers 160 will be included for the user to customize the size of the interior space of the rear housing portion 14. The fingers 178 include flared arms on opposite ends and have slots that are adapted to slidably engage the tabs 174. The spacers 160 are made from a flexible material such as soft rubber or other elastomeric material. The flared arms of the spacers 160 are contoured such that an object may be easily removed from the rear housing portion 14 without becoming caught in a 90 degree corner of an inner compartment. The internal configuration also provides shock resistance in the event of a drop or sudden impact.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A storage container for housing bits comprising:

a first housing portion and a second housing portion pivotally connected through a hinge for moving between open and closed positions, said first housing portion defining a first body cavity, and said second housing portion defining a second body cavity in said closed position and including at least one internal lateral divider wall having a series of locating tabs extending therefrom;

at least one bit holder pivotally connected to said hinge and arranged to fit within said first body cavity in said closed position, said at least one bit holder including a plurality of bit receiving portions formed thereon for accepting the bits, said plurality of bit receiving portions being generally parallel to an axis of the hinge;

at least one adjustable spacer for selectively positioning between said locating tabs; and a cover pivotally connected to said second housing portion and moveable between open and closed positions for accessing said second body cavity.

2. The storage container of claim 1 wherein said adjustable spacer includes a first and second side having a first and second end, said first and second sides being flared outwardly at said first and second ends.

3. The storage container of claim 2 wherein said adjustable spacer is made from an elastomeric material.

4. The storage container of claim 1, further comprising a retaining member extending from said first housing portion into said first body cavity, said retaining member adapted to extend adjacent to predetermined bits of said at least one bit holder to preclude movement of said predetermined drill bits out of said bit receiving portions while said first housing portion is in said closed position.

5. The storage container of claim 4 wherein said at least one bit holder includes a front bit holder lying adjacent to said first housing portion in said closed position and a rear bit holder lying adjacent to an intermediate face of said second housing portion.

6. The storage container of claim 5 wherein said front bit holder extends upward a first distance from a bottom of said first body cavity and said rear bit holder extends upward a second distance from said bottom of said first body cavity, said second distance being greater than said first distance.

7. The storage container of claim 6 wherein said front and rear bit holders each include ridges incorporated on side faces thereof, said side faces facing lateral to and opposite said hinge.

8. The storage container of claim 1 wherein said cover is transparent.

9. The storage container of claim 1 wherein said first housing portion includes an opening formed therein for viewing the bits.

10. A storage container for housing bits comprising:

a first housing portion and a second housing portion pivotally connected through a hinge for moving between open and closed positions, said first housing portion defining a first body cavity, and said second housing portion defining a second body cavity in said closed position;

at least one bit holder pivotally connected to said hinge and arranged to fit within said first body cavity in said closed position, said at least one bit holder including a plurality of bit receiving portions formed thereon for accepting the bits, said plurality of bit receiving portions being generally parallel to an axis of the hinge;

at least one internal lateral divider wall arranged in said second housing portion and having a series of locating tabs extending therefrom; and at least one adjustable spacer for selectively positioning between adjacent locating tabs of said series of locating tabs.

11. The storage container of claim 10 wherein said adjustable spacer includes a first and second side having a first and second end, said first and second sides being flared outwardly at said first and second ends.

12. The storage container of claim 10 wherein said at least one bit holder includes a front bit holder lying adjacent to said first housing portion in said closed position and a rear bit holder lying adjacent to an intermediate face of said second housing portion.

13. The storage container of claim 12 wherein said front bit holder extends upward a first distance from a bottom of said first body cavity and said rear bit holder extends upward a second distance from said bottom of said first body cavity, said second distance being greater than said first distance.

14. The storage container of claim 10, further comprising a transparent cover hingedly attached to said second housing portion.

15. A storage container for housing bits comprising:

a first housing portion and a second housing portion pivotally connected through a hinge for moving between open and closed positions, said first housing portion defining a first body cavity, and said second housing portion defining a second body cavity in said closed position and an internal lateral divider wall having a series of locating tabs extending therefrom;

at least one bit holder pivotally connected to said hinge and arranged to fit entirely within said first body cavity in said closed position, said at least one bit holder including a plurality of bit receiving portions formed thereon for accepting the bits, said plurality of bit receiving portions being generally parallel to an axis of the hinge; and a spacer for selectively positioning between said locating tabs;

wherein said second housing portion includes an intermediate face defining a boundary between said first body cavity and said second body cavity.

16. The storage container of claim 15 wherein said first housing portion includes an inwardly extending ledge formed thereon and wherein said at least one bit holder includes a foot portion, wherein said foot portion of said at least one bit holder overhangs said ledge in said closed position, said ledge cooperating with said foot portion to inhibit physical deflection of said at least one bit holder in a direction toward said ledge.

17. The storage container of claim 15 wherein said adjustable spacer includes a first and second side having a first and second end, said first and second sides being flared outwardly at said first and second ends.

18. The storage container of claim 15, further comprising a transparent cover hingedly attached to said second housing portion.

* * * * *